United States Patent [19]

Vesper

[11] Patent Number: 4,837,950

[45] Date of Patent: Jun. 13, 1989

[54] END LOADING MOTOR SCRAPER

[76] Inventor: Herbert J. Vesper, 1331 Park Ave., S.W. #1002, Albuquerque, N. Mex. 87102

[21] Appl. No.: 199,649

[22] Filed: May 27, 1988

[51] Int. Cl.[4] ..... E02F 1/00

[52] U.S. Cl. ..... 37/4; 37/8; 37/240

[58] Field of Search ..... 37/7–8, 37/4, 20, DIG. 13, 237–240, 192 R; 414/470, 487, 523, 528

[56] References Cited

U.S. PATENT DOCUMENTS

| | | | |
|---|---|---|---|
| 623,496 | 5/1899 | Ward . | |
| 649,114 | 5/1900 | Spalding | 37/8 |
| 1,236,919 | 8/1917 | Emshwiller . | |
| 1,903,675 | 4/1933 | Hauge . | |
| 1,954,593 | 4/1934 | Kuly . | |
| 2,017,477 | 10/1935 | Shippee . | |
| 2,060,688 | 11/1936 | Pryor . | |
| 2,347,882 | 5/1944 | Choate et al. . | |
| 2,564,486 | 8/1951 | MacDonald . | |
| 2,599,838 | 6/1952 | Kandoll . | |
| 2,696,287 | 12/1954 | Foust . | |
| 2,758,528 | 8/1956 | Hulverson . | |
| 2,791,041 | 5/1957 | Hancock . | |
| 2,795,872 | 6/1957 | Wardle . | |
| 2,855,116 | 10/1958 | Moore . | |
| 2,884,742 | 5/1959 | Moore et al. . | |
| 2,904,905 | 9/1959 | Armington . | |
| 2,910,790 | 11/1959 | Armington . | |
| 2,984,022 | 5/1961 | Johnson . | |
| 3,011,273 | 12/1961 | Stumpf | 37/8 |
| 3,054,160 | 9/1962 | Tourneau . | |
| 3,063,173 | 11/1962 | Wardle | 37/4 |
| 3,079,021 | 2/1963 | Kohorst et al. . | |
| 3,126,653 | 3/1964 | Bourgeous . | |
| 3,308,563 | 3/1967 | Daner | 37/237 |
| 3,346,975 | 10/1967 | LaJoye . | |
| 3,391,776 | 7/1968 | Hancock et al. . | |
| 3,419,975 | 1/1969 | MacDonald . | |
| 3,445,946 | 5/1969 | Striggow | 37/4 X |
| 3,621,919 | 11/1971 | Olson . | |
| 3,742,405 | 6/1973 | Bowman et al. | 37/4 |
| 3,791,052 | 2/1974 | Van Der Lely | 37/8 |
| 3,907,093 | 9/1975 | Skibo . | |
| 3,922,803 | 12/1975 | Umeda et al. . | |
| 4,063,375 | 12/1977 | Satterwhite . | |
| 4,253,256 | 3/1981 | Feliz | 37/4 |
| 4,313,502 | 2/1982 | Nelson . | |

FOREIGN PATENT DOCUMENTS

| | | |
|---|---|---|
| 911118 | 11/1962 | United Kingdom . |

*Primary Examiner*—Eugene H. Eickholt

*Attorney, Agent, or Firm*—Hoffman, Wasson, Fallow & Gitler

[57] ABSTRACT

An earthmover having a bowl for transporting earth includes an elevating loading apparatus pivotally attached to the bowl. The loading apparatus can be raised or lowered with respect to the bowl; in addition, the bowl can be tilted about the longitudinal axis of the machine in order to provide cross-slope control during both loading and spreading operations.

2 Claims, 5 Drawing Sheets

END LOADING MOTOR SCRAPER

BACKGROUND OF THE INVENTION

1. Field of the Invention

This invention relates to excavating equipment, and more particularly to a self-loading earthmover having an endless conveyor.

2. Description of the Prior Art

Elevating scrapers, particularly the Hancock type, have become popular in recent years. Such scrapers are basically built according to U.S. Pat. No. 2,791,041, and are produced for Caterpillar by the Eagle Picher Company of Lubbock, Tex. All commercially available device are characterized by having a tractor or power unit immediately before the scraper blade. Such devices load material into an open bowl by dragging the material being loaded over the material already loaded, a process which involves an unnecessary expenditure of energy. In addition, the known machines, lacking means for controlling cross-slope distribution of material, are ill-suited for creating road crowns and the like.

SUMMARY OF THE INVENTION

The primary object of the invention is to improve the versatility of a machine for loading, transporting and spreading material.

A related object is to enable one to control independently the suspension of the scraper blade for depth of cut, travel height, and for tilt or listing of the cutting edge and strike-off or spreading blade, and for vertical cut control.

Another object is to improve visibility from the operator's compartment.

Yet another object is to eliminate spillage from the bowl of the device, and to increase the carrying capacity of the bowl without increasing its dimensions.

An object of the invention is to eliminate cumbersome mechanical adjustments and drives from an earth moving machine.

A related object is to enable one to control the flow of power to the individual drive wheels of the machine.

Yet another objective is to provide the industry with a machine that is sturdy, compact, durable, simple, safe, efficient, versatile and reliable, yet easy to manufacture, operate and maintain.

The loader according to the present invention includes a scraping or cutting edge at the very front end of the machine, so that the machine can be used to load material directly from a stockpile or from the face of a bank, and then transport and distribute the load along a road construction site. An advantage provided by the cutting edge placement is that all wheels of the vehicle run upon a clean surface that has been scraped over, so that operation is smoother and traction is improved, particularly in muddy or rocky terrains.

In addition, the entire machine can be tilted around its longitudinal axis left or right, with respect to its wheels, thus giving cross-slope control during loading, as well as during dumping and spreading cycles.

BRIEF DESCRIPTION OF THE DRAWINGS

In the accompanying drawings.

DESCRIPTION OF THE PREFERRED EMBODIMENT

Figure 1:
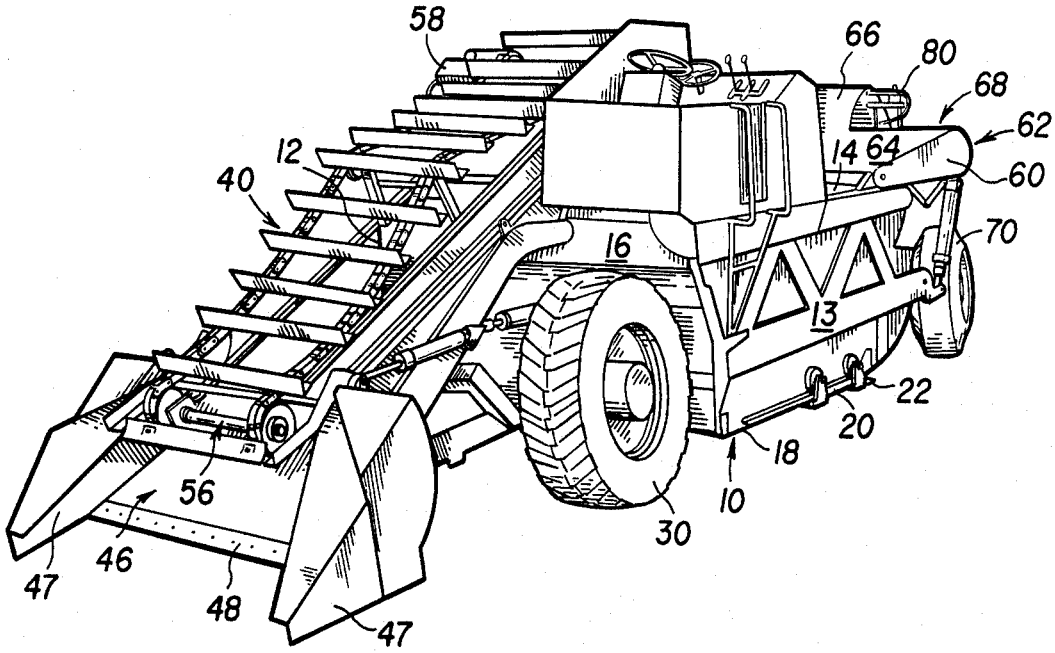
FIG. 1 is a perspective view of a machine embodying the invention, somewhat simplified for the sake of clarity.
Figure 4:
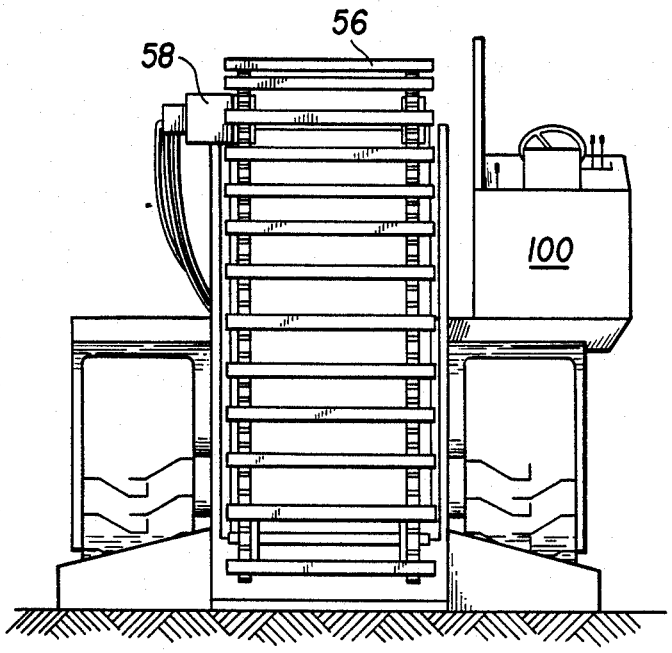
FIG. 4 is a front elevation of the machine.
Figure 2:
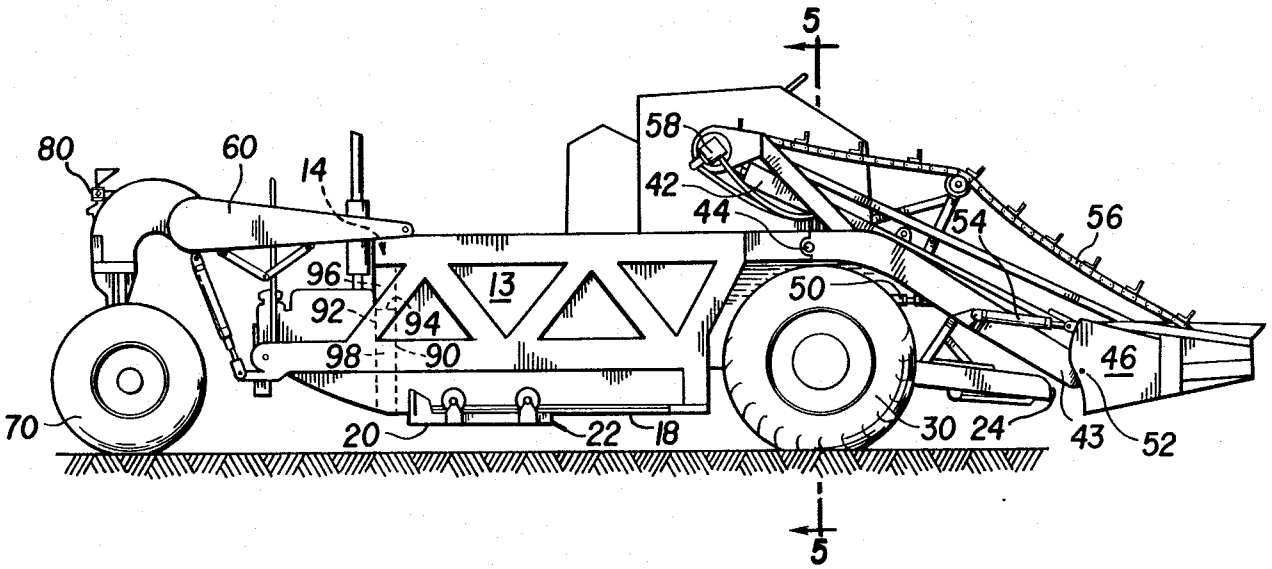
FIG. 2 is a side elevation of the machine.
Figure 3:
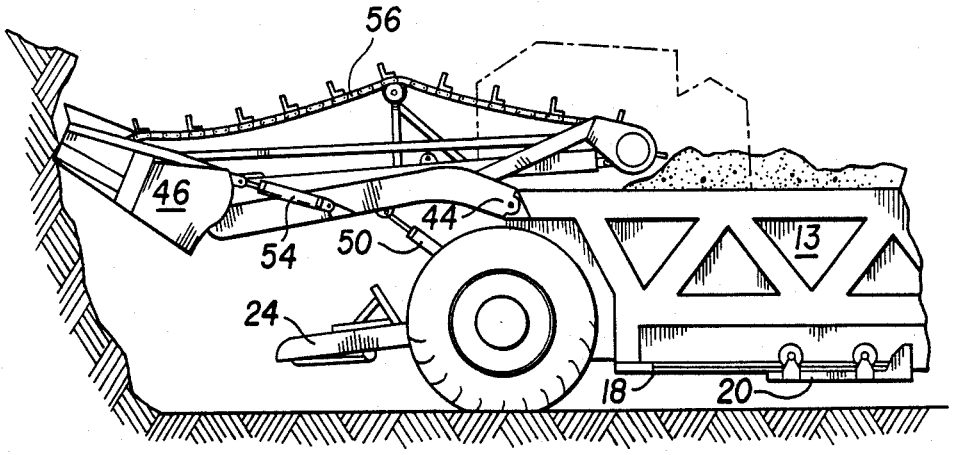
FIG. 3 is a side elevation corresponding to FIG. 2, partially broken away to show vertical loading.

An earthmoving machine embodying the invention is shown in FIGS. 1 through 5. The machine includes an earth transporting bowl 10 having two side walls 12 and 13, a back end wall 14 and a front end wall 16. (Throughout this description, the end of the machine having the loader thereat will be referred to the "front", although it will become apparent that the machine is truly bidirectional in operation. Also, throughout this description, "longitudinal" means along the length of the machine, parallel to its straightahead direction of travel, and "transverse" is the horizontal direction perpendicular to the longitudinal.) The front end wall 16 is hydraulically movable toward the rear of the bowl by means of a hydraulic cylinder so that it can act as an ejector plate to clear the bowl. The bowl also has a bottom 18 having an opening at the rearward end thereof that is normally covered by a rolling floor door 20 within the bowl. The door is operated by a hydraulic cylinder so that it can be opened during dumping or spreading operations; the door also has a downwardly inclined spreader blade 22 affixed to the rearward edge thereof to distribute material as it is dumped. The dumping doors and ejector mechanism are otherwise of conventional design, and thus are not shown or described in detail.

A rigid open frame 24 extends forward from the front wall of the bowl. By means of a longitudinally extending pin 26 (FIG. 5), a transverse axle 28 is connected at its midpoint to the bowl frame. A pair of wheels 30, mounted for rotation the axle 28, are independently driven by conventional hydraulic motors 32. A vertical hydraulic cylinder 36 is connected between the axle and the frame, whereby the bowl can be tilted left or right as desired to achieve cross-slope control.

A bowl loading apparatus 40 (FIGS. 1–4) extends forwardly from the bowl. The apparatus includes an elevator slide 42 having two downwardly extending feet 43 hinged to the top front edge of the bowl frame, at pivot points 44. The slide normally descends obliquely forward from the pivot points, terminating at a bucket 46 including a spaced pair of converging material guides 47 with a scraper blade 48 removably attached therebetween by bolts. Since the blade is easily removed, scraper blades of different shapes may be attached, which renders the machine particularly versatile. The elevator slide may be raised by extending hydraulic cylinders 50 shown in FIG. 3, to swing the bucket vertically so as, for example, to cut vertical banks. The bucket is connected to the slide by means of a laterally extending hinge 52; pivoting of this hinge is controlled by a horizontally extending hydraulic cylinder 54 which can be extended or retracted to lower or raise the blade with respect to the slide and thus change the angle of attack of the blade.

A chain and flight elevator 56 is attached to the loading slide. The lower end of the elevator is just above the scraper blade, between the guides, while the upper end extends above the level of the front wall 16. Inasmuch as such elevators are well known in the art of earthmoving, being shown for example in U.S. Pat. No. 2,791,041, above, internal details of the elevator are not shown or described. The conveyor is driven by a hydraulic motor 58 mounted at the rearward end of the elevator on the right side thereof.

Figure 6:
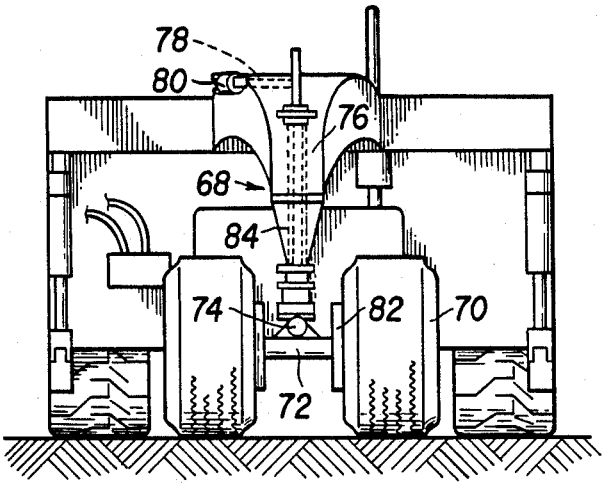
FIG. 6 is a rear elevation of the invention.
Figure 5:
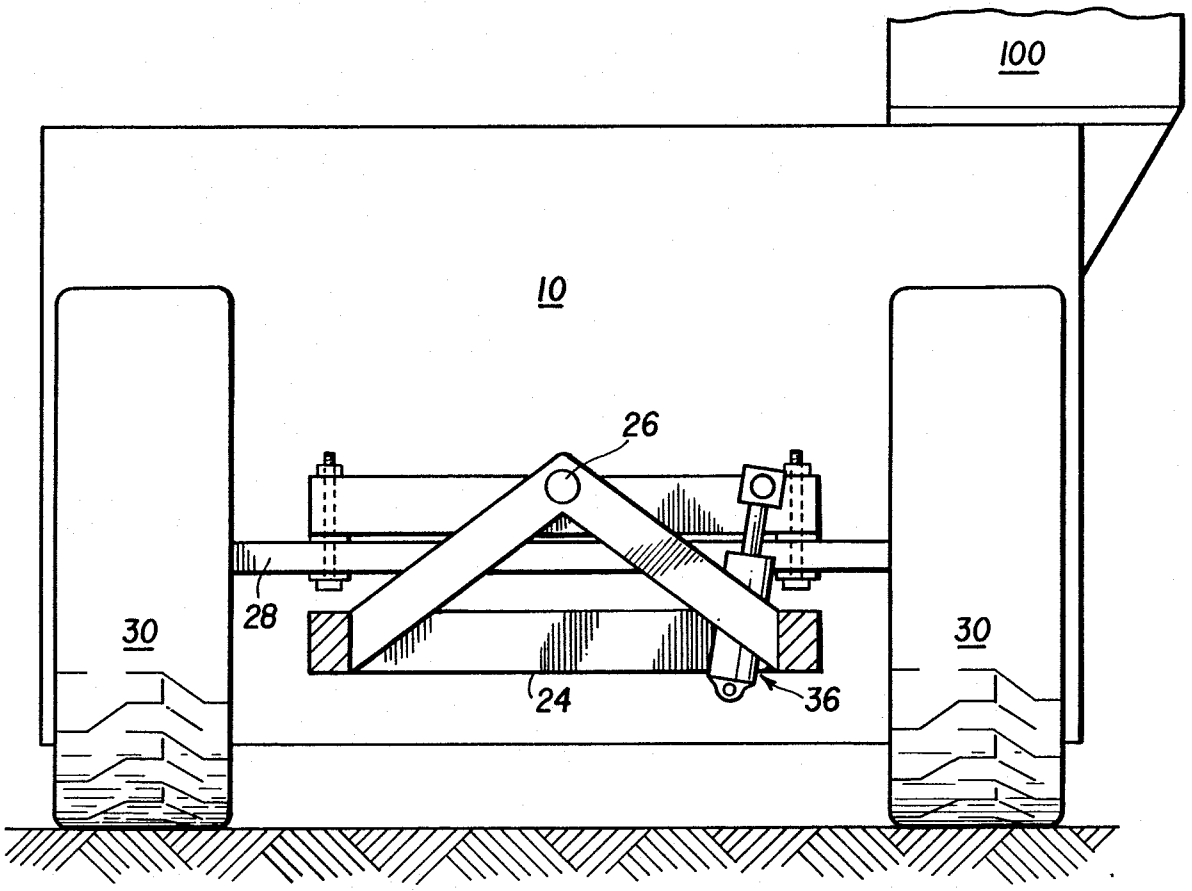
FIG. 5 is a sectional view taken along the line 5—5 in FIG. 2.
Figure 7:
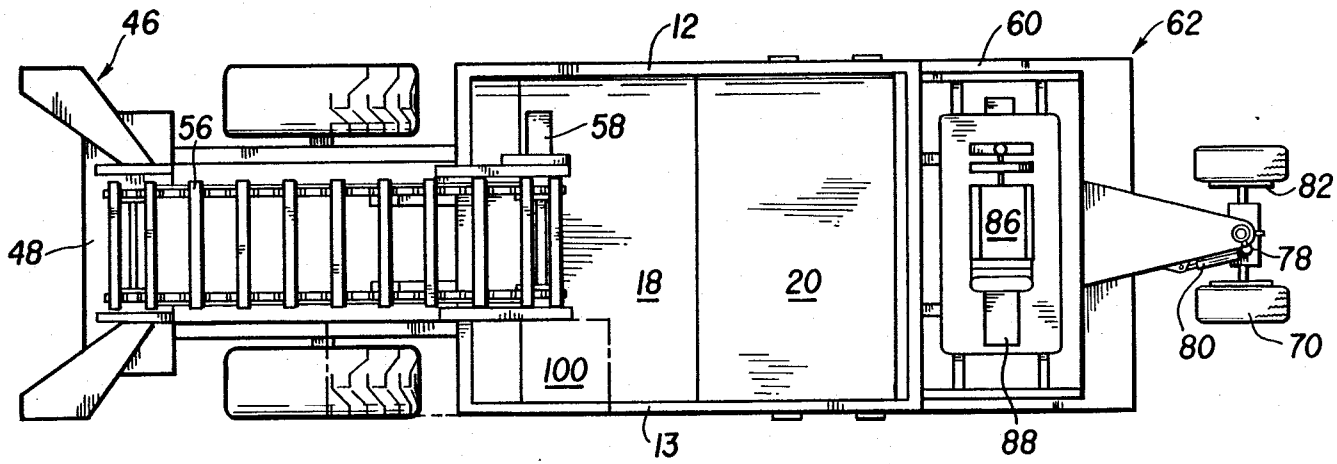
FIG. 7 is a top plan view of the invention.

The side walls 12 and 13 of the bowl 10 are pivotally connected to the forwardly extending arms 60 of a bowl-supporting yoke 62, which yoke has a crossbar 64 and a rearwardly extending central tongue 66 supported by a steering unit 68 as best seen in FIG. 6. A pin connection 74 between the tongue and the steering unit permits relative rotation, around a longitudinal axis, thus permitting the bowl to tilt when desired. The steering unit 68 includes a pair of rear wheels 70, more narrowly spaced than the front wheels, so that the treads of the front and rear wheels do not overlap, but rather, cover a substantial part of the width of the machine and therefore act as a pneumatic roller in operation. The rear wheels are mounted on an axle 72 connected to a vertical kingpin 73, which can be rotated with respect to the frame 76 of the unit by means of arm 78 and cylinder 80 at least 90 in either direction, whereby the turning radius of the machine is minimized (i.e., the machine can rotate around the center point of its front axle). Each of the steering wheels is driven by means of a hydraulic motor 82 similar to the motors that drive the rear wheels. Preferably, the front and rear wheel motors are individually controllable. In addition, there is a vertically extendable hydraulic cylinder 84 incorporated into the steering unit, so that the elevation of the yoke, and thus that of the bowl, can be varied in order to dump or spread material that has been collected in the bowl.

A diesel engine 86 and four hydraulic pumps 88 driven thereby are mounted at the rear of and behind the bowl. Such prime movers are known in the art. Suffice it to say that the pump draws fluid from a reservoir (described below) and delivers it under high pressure to the various hydraulic motors and cylinders of the system under the direction of conventional operator controls, not shown. Although we prefer a hydraulic drive for a variety of reasons, one could substitute electric components. Regardless of the form of the secondary power sources, each such unit is connected by lines and controls at the operator's station.

The fuel tank for the prime mover, and the hydraulic fluid reservoir, are built into the rear wall of the bowl. The rear wall 14 is actually a double wall, formed of two metal sheets 90,92 (FIG. 2) defining a volume therebetween. This volume is divided vertically by a horizontally extending partition 94; two compartments are thus defined. The upper compartment 96 is used as the fuel tank, as this location simplifies servicing of fuel line components, as it permits gravity bleeding of the system. The lower compartment 98 is used as the hydraulic fluid reservoir. This arrangement permits heat transfer from the hydraulic fluid to the fuel, which is advantageous particularly in cold weather. Furthermore, there is a large heat transfer area provided for the hydraulic fluid reservoir, and in fact when the bowl is loaded (and heat dissipation requirements are the highest) the load in the bowl acts as a heat sink for fluid in the front wall tank.

The operator's compartment 100 is positioned at the left of the conveyor, behind the left front wheel, in order to provide the operator good visibility of the blade. The operator's seat and controls are reversible, so that he can readily adjust himself to travelling in either direction.

In operation, the operator, through appropriate manipulation of the controls, causes the machine to move forward over or toward material to be gathered. If material is to be cut from the ground surface, the cutter blade is set at the appropriate depth, and material is gathered into the loading bucket as the machine advances. During the gathering mode of operation, the conveyor, continuously driven by its hydraulic motor, delivers material from the bucket over the front wall of the bowl. The material carried by the conveyor never contacts that in the bowl, no matter how full it is. As a result, there is no drag on the conveyor, and there is no spillage from the bowl. The bucket can also be raised as desired by extension of the cylinders 50 so that material can be cut from banks, stockpiles and the like. During the loading operation, the cutter blade can be angled right or left by tilting the bowl, by appropriately extending or retracting the cylinder 36. When the bowl is full, the machine is driven to a desired location, and the load is dumped by raising the bowl and opening the dump door 20 as the machine advances, preferably in the rearward direction. The material may be distributed by the spreader blade as it is discharged, by judiciously controlling the bowl height, and again, the cross slope of the spread material can be controlled by tilting the bowl left or right. This feature is particularly useful in building up road crowns and so forth.

Various modifications may be may to the invention. For example, the hydraulic features could be replace by electrical or mechanical counterparts. Also, the various hydraulic cylinders could be replaced by any linear motor capable of extension and retraction.

Inasmuch as the invention is subject to other variations and changes in detail, it is intended that the foregoing be interpreted as only illustrative of the invention, whose scope is to be measured by the following claims.

I claim:

1. An earthmover comprising a bowl having a bottom, opposing side walls, and front and back walls, said bottom having a dump opening provided with doors and means for controlling operation of the doors;

a loading apparatus pivotally connected to said front wall at the top thereof, said loading apparatus comprising a bucket having a cutter blade for cutting material, and a material elevator connected between said bucket and said bowl, said elevator extending at its forward end into said bucket for removing material therefrom to said bowl;

a pair of front wheels supporting said bowl, a steering unit comprising a pair of rear wheels at the rear of the bowl, a yoke supported by the steering unit, said yoke having a pair of forwardly extending arms each pivotally connected to a side wall of the bowl, means for raising the yoke with respect to the rear wheels whereby the bowl elevation may be varied, said yoke being pivotable around a longitudinal axis, with respect to the steering unit, and means for tilting the bowl with respect to the front wheels, whereby the bowl and the loading apparatus may be tilted with respect to the ground during operation of the earthmover.

2. In an earthmover having a load transporting bowl, a loading bucket movably attached to the bowl, an elevator for transferring material from the bucket to the bowl, and at least three ground contacting wheels upon which the bowl is supported, means for mounting two of said wheels for rotation about a common axis, and means for varying the elevation of the bowl, the improvement, in combination with the foregoing, wherein the bowl is pivotally connected to said wheel mounting means, and further comprising a linear motor extending between said wheel mounting means and said bowl for tilting said bowl about its longitudinal axis with respect to said wheel mounting means so as to obtain cross-slope control, and further comprising a yoke for supporting the bowl, said yoke including a pair of spaced arms pivotally connected to respective ones of said side walls, said arms extending rearwardly from their connection points to a rearwardly extending tongue, said tongue being attached by means of a longitudinally extending pin connection to the steering mechanism.

* * * * *